US007059132B2

(12) United States Patent
Odani et al.

(10) Patent No.: US 7,059,132 B2
(45) Date of Patent: Jun. 13, 2006

(54) STEAM GENERATOR FEEDWATER CONTROL SYSTEM FOR POWER PLANT

(75) Inventors: Kazumasa Odani, Hitachi (JP); Masayuki Nagasawa, Hitachi (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 11/209,761

(22) Filed: Aug. 24, 2005

(65) Prior Publication Data

US 2006/0042249 A1 Mar. 2, 2006

(30) Foreign Application Priority Data

Aug. 25, 2004 (JP) ..... 2004-244556

(51) Int. Cl.
*F01K 13/02* (2006.01)

(52) U.S. Cl. ..... 60/646; 60/657; 60/660; 60/665

(58) Field of Classification Search ..... 60/646, 60/657, 660, 664, 665
See application file for complete search history.

(56) References Cited

U.S. PATENT DOCUMENTS 3,163,009 A * 12/1964 Rankin ..... 60/652
4,445,180 A * 4/1984 Davis et al. ..... 700/289
4,478,783 A * 10/1984 Broadwater ..... 376/211
4,651,530 A * 3/1987 Omori ..... 60/667

FOREIGN PATENT DOCUMENTS

JP 56-82303 7/1981
JP 58-33002 2/1983

* cited by examiner

*Primary Examiner*—Hoang Nguyen
(74) *Attorney, Agent, or Firm*—Dickstein Shapiro Morin & Oshinsky LLP

(57) ABSTRACT

In the control of feedwater to the steam generator in a power plant comprising one steam generator and a plurality of turbine plants, the water level in the steam generator and the flow rate balance between the steam flow rate and the feedwater flow rate of each turbine plant will be stabilized. In the power plant comprising one steam generator and a plurality of turbine plants combined, the control in the feedwater controller of the first turbine plant (main turbine plant) is normal control, that is, to control the feedwater control valve through the use of detection signals from the steam generator level detecting unit, the main steam flow detecting unit and the feedwater flow detecting unit of the first turbine plant, and the control in the feedwater controller of the second turbine plant (duplicate turbine plant) is to control the feedwater control valve through the use of a detection signal from the condenser level detecting unit of the first turbine plant.

11 Claims, 7 Drawing Sheets

STEAM GENERATOR FEEDWATER CONTROL SYSTEM FOR POWER PLANT

FIELD OF THE INVENTION

The present invention relates to a feedwater control system for a steam generator in a power plant, and more particularly to a feedwater control system for a steam generator in a power plant comprising a steam generator and a plurality of turbine plants combined.

BACKGROUND OF THE INVENTION

In the power plant, steam generated in, for embodiment, an atomic reactor (steam generator) drives a turbine, is condensed by a condenser, and water thus condensed is supplied to the atomic reactor via a pump and a feedwater control valve. In such a system, an amount of feedwater to the atomic reactor, which is a steam generator, is controlled by inputting an atomic reactor level signal, a main steam flow signal and a feedwater flow signal into a feedwater controller, by adding, in the feedwater controller, a deviation signal between steam flow rate and feedwater flow rate to a deviation signal between the atomic reactor level and the set point for carrying out a PI operation, and by controlling an opening of the feedwater control valve on the basis of an output signal from this feedwater controller. Such a feedwater control system has been described in, for embodiment, JP-A No. 33002/1983.

SUMMARY OF THE INVENTION

In a general power plant, as regards combination of the steam generator and turbine plant, it is comprised of one steam generator and one turbine plant. In this case, the feedwater control system is made into a control system for three elements (water level, main steam flow rate, feedwater flow rate) in that the main steam flow signal and the feedwater flow signal have been introduced into the level control signal of the steam generator as lead signals as described above, whereby the water level in the steam generator and flow rate balance between the main steam flow rate and the feedwater flow rate are stabilized.

However, a problem of feedwater control when a power plant has been constructed by combining one steam generator and a plurality of turbine plants has not been studied so far. In other words, in the case of a power plant comprising one steam generator and a plurality of turbine plants combined, steam generated from the steam generator is diverted and is supplied as turbine driving steam for the plurality of turbine plants and water condensed by the condensers for the respective turbine plants is supplied to the steam generator after merging via the respective pumps and feedwater control valves. In such a system structure, when the feedwater control systems for each turbine plant are made into such a conventional control system as described above, the water level in one steam generator is controlled by a plurality of feedwater control valves, whereby both control systems are to clash with each other, and it is anticipated that the steam generator level and the flow rate balance between the main steam flow rate and the feedwater flow rate will become unstable.

Also, in a case where a power plant in which a main turbine plant having a steam generator and a duplicate turbine plant having no steam generator are combined and as turbine driving steam for the duplicate turbine plant, surplus steam generated from the steam generator for the main turbine plant is used, when supply flow rate of the surplus steam on the duplicate turbine plant side increases or decreased, supply flow rate of the main steam on the main turbine plant side is to decrease or increase inversely, and it is anticipated that the steam generator level and the flow rate balance between the main steam flow rate and the feedwater flow rate of each turbine plant will become unstable.

It is an object of the present invention to provide, in a power plant comprising at least one steam generator and a plurality of turbine plants combined, a feedwater control system capable of controlling the water level in the steam generator and/or the flow rate balance between the main steam flow rate and the feedwater flow rate with stability.

The above-described object is achieved by controlling the feedwater system of one turbine plant (main turbine plant) in accordance with the conventional control system (for embodiment, system for controlling on the basis of a water level signal from the steam generator), and controlling the feedwater system of the other turbine plant (duplicate turbine plant) in accordance with a system for controlling on the basis of quantity of state (for embodiment, water level in the condenser or the deaerator) of the condenser or the feedwater system of one turbine plant (main turbine plant).

According to the present invention, in the power plant comprising at least one steam generator and a plurality of turbine plants combined, it becomes possible to control the water level in the steam generator and/or the flow rate balance between the main steam flow rate and the feedwater flow rate with stability.

In other words, since the feedwater system of one turbine plant has been controlled on the basis of the water level in the steam generator, even when an amount of feedwater to the steam generator is controlled by a plurality of feedwater systems, it becomes possible to control the water level in the steam generator with stability.

Also, the main turbine plant is generally operated in a fixed state, and the duplicate turbine plant becomes a factor for fluctuations in the water level in the steam generator and flow rate balance between the main steam flow rate and the feedwater flow rate. According to the present invention, since the feedwater system of the main turbine plant is controlled on the basis of the water level in the steam generator, and the feedwater system of the duplicate turbine plant is controlled on the basis of the water level in the condenser or the like of the main turbine plant, the water level in the steam generator and the flow rate balance between the main steam flow rate and the feedwater flow rate can be stabilized.

DETAILED DESCRIPTION OF THE PREFERRED EMBODIMENTS

Hereinafter, with reference to the drawings, the description will be made of embodiments of the present invention.

Figure 1:
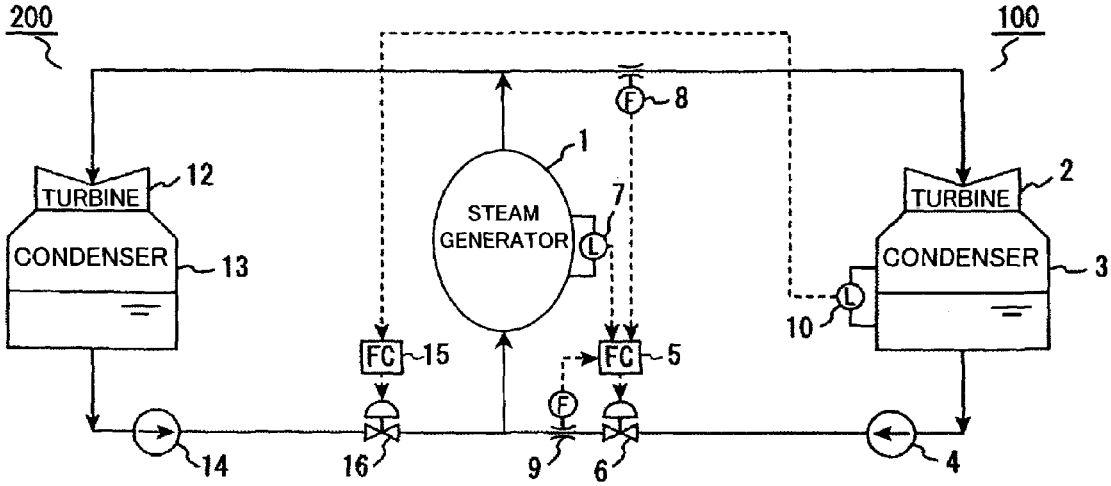
FIG. 1 is an explanatory view when the present invention has been applied to a feedwater control system for a power plant comprising one steam generator and two turbine plants combined (first embodiment)

FIG. 1 is an explanatory view when the present invention has been applied to a feedwater control system for a power plant comprising one steam generator and two turbine plants combined.

In the present embodiment, the system is constructed such that steam generated in the steam generator 1 is diverted and supplied as turbine driving steam for the first turbine plant (main turbine plant) 100 and the second turbine plant (duplicate turbine plant) 200, and the steam flowed into each turbine 2, 12 flows into the condenser 3, 13 after driving the turbine 2, 12, and water condensed by the condenser 3, 13 merges via the pump 4, 14 and the feedwater control valve 6, 16 and is fed into the steam generator 1.

The feedwater control system (hereinafter, referred to as first feedwater control system) for the first turbine plant 100 is comprised of: a steam generator level detecting unit 7; a main steam flow detecting unit 8; a feedwater flow detecting unit 9; and a feedwater controller 5. A detection signal from each detecting unit is inputted into the feedwater controller 5, and the feedwater controller 5 outputs a signal that has been controlled and operated so as to make the water level in the steam generator 1 constant into the feedwater control valve 6. This feedwater control valve 6 is open-close adjusted, whereby a feedwater flow rate from the first turbine plant to the steam generator 1 is controlled.

On the other hand, the feedwater control system (hereinafter, referred to as second feedwater control system) for the second turbine plant 200 inputs a signal from a condenser level detecting unit 10 for the first turbine plant 100 into a feedwater controller 15; and a signal that has been controlled and operated so as to make the water level in a condenser 3 in the first turbine plant 100 constant is outputted from the feedwater controller 15 to the feedwater control valve 16 in such a manner that the flow rate of feedwater from the second turbine plant to the steam generator 1 is controlled.

In other words, when a flow rate of surplus steam to be supplied on the second turbine plant (duplicate turbine plant) side increases, a flow rate of main steam to be supplied on the first turbine plant (main turbine plant) side decreases, but this decrease in the flow rate of main steam causes the water level in the condenser and the like on the main turbine side to lower.

Also, when the flow rate of the surplus steam to be supplied on the duplicate turbine plant side decreases, the flow rate of main steam to be supplied on the main turbine plant side increases, but this increase in the flow rate of main steam causes the water level in the condenser 3 and the like on the main turbine plant side to rise. In this case, when the flow rate of surplus steam to be supplied on the duplicate turbine plant side increases or decreases, the flow rate of main steam on the main turbine plant side decreases or increases, whereby the water level in the condenser 3 and the like on the main turbine plant side is to lead to lowering or rising. Therefore, when the water level in the condenser 3 and the like on the main turbine plant side lowers, in order to increase the flow rate of main steam to be supplied on the main turbine plant side, the feedwater control valve 16 on the duplicate turbine plant side is operated to the open side to thereby increase the flow rate of feedwater from the duplicate turbine plant side to the steam generator. Thereby, the water level in the condenser 3 is restrained from lowering. Also, when the water level in the condenser 3 on the main turbine plant side rises, in order to decrease the flow rate of main steam to be supplied on the main turbine plant side, the feedwater control valve 16 on the duplicate turbine plant side is operated to the close side to thereby decrease the flow rate of feedwater from the duplicate turbine plant side to the steam generator. Thereby, the water level in the condenser 3 is restrained from rising. As described above, the feedwater control valve 16 on the duplicate turbine plant side is controlled in accordance with the water level in the condenser 3 on the main turbine plant side, whereby the flow rate balance between the main steam flow rate and the feedwater flow rate of each plant can be stabilized.

In the present embodiment 1, although plural feedwater control systems exist, the water level in the steam generator 1 is controlled to become constant only by the first feedwater control system on the first turbine plant 100 side, whereby the water level in the steam generator 1 is to be stabilized. Also, since a water level signal from the condenser 3 on the first turbine plant 100 side is inputted into the second feedwater control system on the second turbine plant 200 side and the feedwater control valve 16 is controlled such that the water level in the condenser 3 becomes constant, the flow rate balance between the main steam flow rate and the feedwater flow rate of each turbine plant is to be stabilized.

Figure 2:
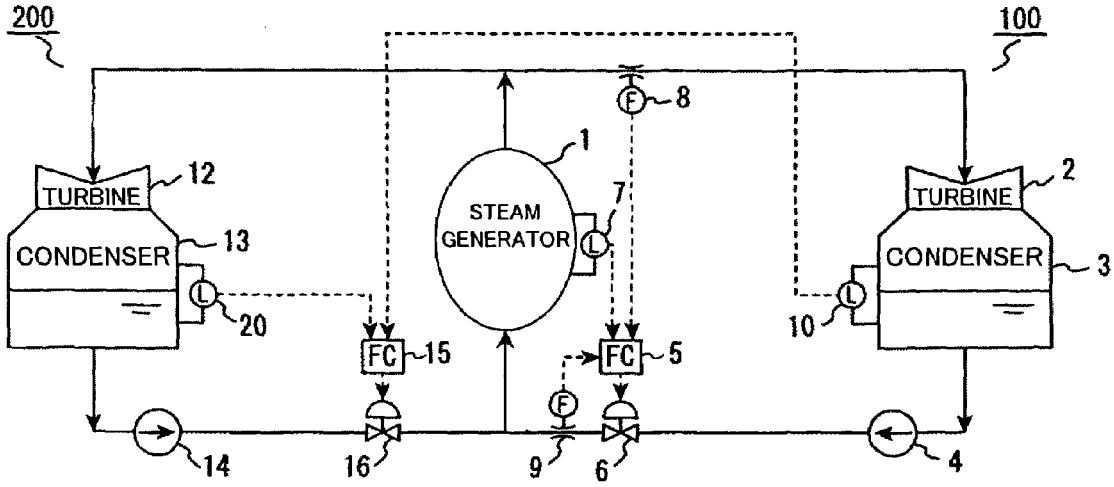
FIG. 2 is an explanatory view when the present invention has been applied to a feedwater control system for a power plant comprising one steam generator and two turbine plants combined (second embodiment)

With reference to FIG. 2, the description will be made of a second embodiment. In the present embodiment, in the structure of the power plant of the embodiment shown in FIG. 1, that is, a power plant comprising one steam generator and two turbine plants combined, the structure has been arranged such that a signal from the level detecting unit 20 of the condenser 13 of the second turbine plant 200 is inputted into the feedwater controller 15 of the second turbine plant 200.

The structure of the first feedwater control system of the first turbine plant 100 is similar to the embodiment of FIG. 1, and the description will be omitted. Although the second feedwater control system of the second turbine plant 200 is also substantially similar to the embodiment of FIG. 1, in the present embodiment, a signal from the condenser level detecting unit 20 of the second turbine plant 200 has been further inputted into the feedwater controller 15. The feedwater controller 15 basically outputs a signal that has been controlled and operated so as to make the water level in the condenser 3 of the first turbine plant constant into the feedwater control valve 16 to control the feedwater flow rate from the second turbine plant to the steam generator 1. Further, an output signal from the feedwater controller 15 is corrected by a detection signal from the condenser water level detecting unit 20. In other words, when an imbalance occurs between a steam flow rate from the steam generator 1 to the second turbine plant 200 and a feedwater flow rate from the second turbine plant 200 to the steam generator 1 for some main cause or other, the water level in the condenser 13 of the second turbine plant 200 fluctuates, when the water level in the condenser 13 rises to exceed a predetermined value, the turbine will be damaged, and when the same water level lowers below a predetermined value, bubble inclusions will occur and there is a possibility that the pumps in the latter part will be damaged. In the present embodiment, in order to maintain the water level in the condenser 13 at a predetermined value, an output signal from the feedwater controller 15 is corrected through the use of a signal from the condenser level detecting unit 20 to control the feedwater control valve 16.

In the present embodiment 2, in addition to the effect of the first embodiment, a condenser water level signal on the second turbine plant 200 side is inputted into the second feedwater control system on the second turbine plant 200 side and this signal is used as a signal for correcting a control signal of the feedwater control valve 16, whereby the flow rate balance between the main steam flow rate and the feedwater flow rate of each plant can be further stabilized.

Figure 3:
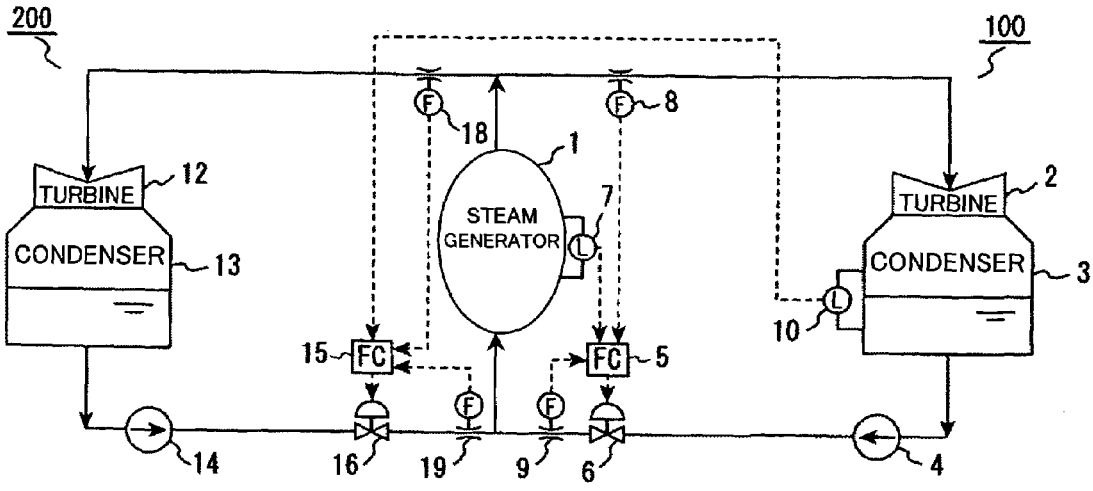
FIG. 3 is an explanatory view when the present invention has been applied to a feedwater control system for a power plant comprising one steam generator and two turbine plants combined (third embodiment)

FIG. 3 shows a third embodiment. In the present embodiment, in the structure of the power plant of the embodiment shown in FIG. 1, that is, a power plant comprising one steam generator and two turbine plants combined, the structure has been arranged such that signals from a main steam flow detecting unit 18 and a feedwater flow detecting unit 19 of the second turbine plant 200 are inputted into the feedwater controller 15 of the second turbine plant 200.

The structure of the first feedwater control system of the first turbine plant 100 is similar to the embodiment of FIG. 1, and the description will be omitted. Although the second feedwater control system of the second turbine plant 200 is also substantially similar to the embodiment of FIG. 1, in the present embodiment, signals from the main steam flow detecting unit 18 and the feedwater flow detecting unit 19 of the second turbine plant 200 have been further inputted into the feedwater controller 15. The feedwater controller 15 basically outputs a signal that has been controlled and operated so as to make the water level in the condenser 3 of the first turbine plant constant into the feedwater control valve 16 to control the feedwater flow rate from the second turbine plant to the steam generator 1. Further, an output signal from the feedwater controller 15 is corrected by detection signals from the main steam flow detecting unit 18 and the feedwater flow detecting unit 19. In other words, in the present embodiment, an imbalance occurs between the steam flow rate from the steam generator 1 to the second turbine plant 200 and the feedwater flow rate from the second turbine plant 200 to the steam generator 1, and in order to prevent the water level in the condenser 13 of the second turbine plant 200 from fluctuating to exceed a predetermined value, an output signal from the feedwater controller 15 is corrected through the use of detection signals from the main steam flow detecting unit 18 and the feedwater flow detecting unit 19 to control the feedwater control valve 16.

In the present embodiment 3, in addition to the effect of the first embodiment, a main steam flow signal and a feedwater flow signal on the second turbine plant 200 side are inputted into the second feedwater control system on the second turbine plant 200 side and these signals are used as a signal for correcting a control signal of the feedwater control valve 16, whereby the flow rate balance between the main steam flow rate and the feedwater flow rate of each plant can be further stabilized.

Figure 4:
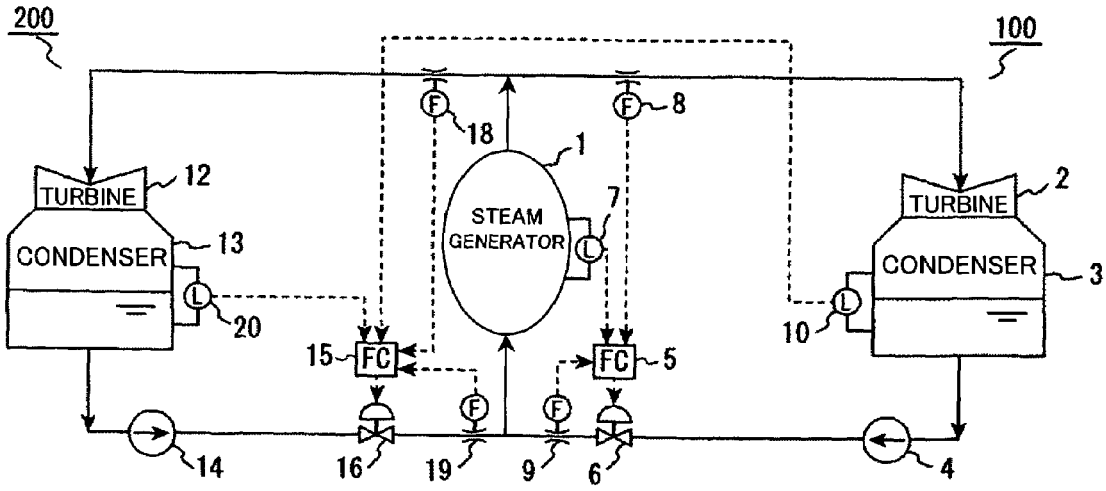
FIG. 4 is an explanatory view when the present invention has been applied to a feedwater control system for a power plant comprising one steam generator and two turbine plants combined (fourth embodiment)

FIG. 4 shows a fourth embodiment. The present embodiment is a combination of the second embodiment and the third embodiment. That is, in a power plant comprising one steam generator and two turbine plants combined, the structure has been arranged such that signals from a condenser water level detecting unit 20, a main steam flow detecting unit 18 and a feedwater flow detecting unit 19 of the second turbine plant 200 are inputted into the feedwater controller 15 of the second turbine plant 200.

The structure of the first feedwater control system of the first turbine plant 100 is similar to the embodiment of FIG. 1, and the description will be omitted. Although the second feedwater control system of the second turbine plant 200 is also substantially similar to the embodiment of FIG. 1, in the present embodiment, signals from the condenser level detecting unit 20, the main steam flow detecting unit 18 and the feedwater flow detecting unit 19 of the second turbine plant 200 have been further inputted into the feedwater controller 15. The feedwater controller 15 basically outputs a signal that has been controlled and operated so as to make the water level in the condenser 3 of the first turbine plant constant into the feedwater control valve 16 to control the feedwater flow rate from the second turbine plant to the steam generator 1. Further, an output signal from the feedwater controller 15 is corrected by detection signals from the condenser level detecting unit 20, the main steam flow detecting unit 18 and the feedwater flow detecting unit 19. In other words, in the present embodiment, an imbalance occurs between the steam flow rate from the steam generator 1 to the second turbine plant 200 and the feedwater flow rate from the second turbine plant 200 to the steam generator 1, and in order to prevent the water level in the condenser 13 of the second turbine plant 200 from fluctuating to exceed a predetermined value, an output signal from the feedwater controller 15 is corrected through the use of detection signals from the main steam flow detecting unit 18 and the feedwater flow detecting unit 19 to control the feedwater control valve 16. In the present embodiment 4, in addition to the effect of the first embodiment, effects of the second and third embodiments can be exhibited.

Figure 5:
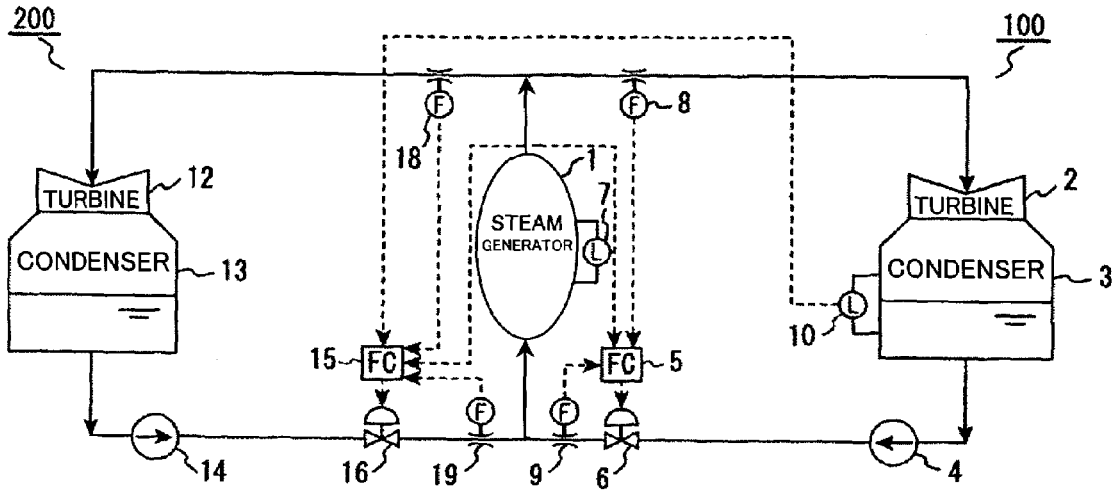
FIG. 5 is an explanatory view when the present invention has been applied to a feedwater control system for a power plant comprising one steam generator and two turbine plants combined (fifth embodiment)

With reference to FIG. 5, the description will be made of a fifth embodiment. In the present embodiment, in the structure of the power plant of the embodiment shown in FIG. 1, that is, a power plant comprising one steam generator and two turbine plants combined, the structure has been arranged such that signals from the steam generator level detecting unit 7, the main steam flow detecting unit 18 and the feedwater flow detecting unit 19 of the second turbine plant 200 are inputted into the feedwater controller 15 of the second turbine plant 200.

The structure of the first feedwater control system of the first turbine plant 100 is similar to the embodiment of FIG. 1, and the description will be omitted. Although the second feedwater control system of the second turbine plant 200 is also substantially similar to the embodiment of FIG. 1, in the present embodiment, signals from the steam generator level detecting unit 7, and the main steam flow detecting unit 18 and the feedwater flow detecting unit 19 of the second turbine plant 200 have been further inputted into the feedwater controller 15. The feedwater controller 15 basically outputs a signal that has been controlled and operated so as to make the water level in the condenser 3 of the first turbine plant constant into the feedwater control valve 16 to control the feedwater flow rate from the second turbine plant to the steam generator 1. Further, an output signal from the feedwater controller 15 is corrected by detection signals from the main steam flow detecting unit 18 and the feedwater flow detecting unit 19. Also, although the water level in the steam generator is controlled only by the first feedwater control system on the fist turbine plant side so as to become constant during the operation of the first turbine plant 100, when the first turbine plant 100 stops and only the second turbine plant side operates, the water level in the steam generator 1 is controlled so as to become constant by the second feedwater control system on the second turbine plant side with a water level signal from the steam generator 1, a main steam flow signal and a feedwater flow signal on the second turbine plant side as input, and the flow rate balance between the main steam flow rate on the second turbine plant side and the feedwater flow rate is stabilized. In this respect, in the present embodiment, a water level signal in the steam generator 1 to be inputted into the feedwater controller 15 of the second turbine plant is not used as an input signal for PI control, but is used as a correction signal for an output signal from the feedwater controller 15 using a detection signal from the condenser level detecting unit 10 of the first turbine plant.

In the present embodiment 5, in addition to the effect of the first embodiment, the main steam flow signal and the feedwater flow signal on the second turbine plant 200 side are inputted into the second feedwater control system on the second turbine plant 200 side and these signals are used as a signal for correcting a control signal of the feedwater control valve 16, whereby the flow rate balance between the main steam flow rate and the feedwater flow rate of each plant can be further stabilized. Also, even when only the second turbine plant is operated, the water level in the steam generator can be maintained at a predetermined value.

Figure 6:
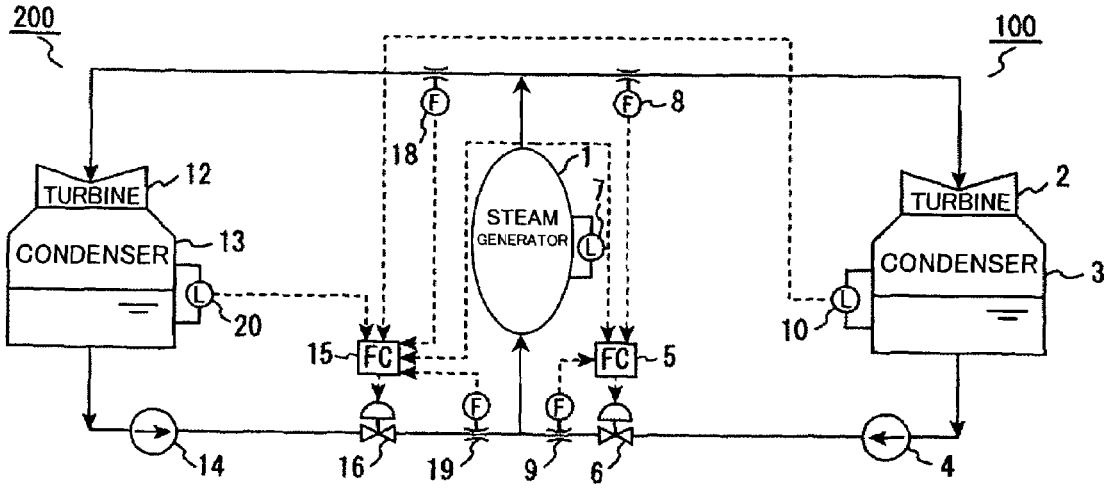
FIG. 6 is an explanatory view when the present invention has been applied to a feedwater control system for a power plant comprising one steam generator and two turbine plants combined (sixth embodiment)

With reference to FIG. 6, the description will be made of a sixth embodiment. Basically, this has the structure similar to the fifth embodiment. In other words, the structure has been arranged such that in addition to signals from the condenser level detecting unit 10, and the steam generator level detecting unit 7 of the first turbine plant, and the main steam flow detecting unit 18 and the feedwater flow detecting unit 19 of the second turbine plant, a signal from the condenser level detecting unit 20 of the second turbine plant is inputted into the feedwater controller 15 of the second turbine plant.

The structure of the first feedwater control system of the first turbine plant 100 is similar to the embodiment of FIG. 1 (FIG. 5), and the description will be omitted. Although the second feedwater control system of the second turbine plant 200 is also substantially similar to the embodiment of FIG. 5, in the present embodiment, a signal from the condenser level detecting unit 20 of the second turbine plant has been further inputted into the feedwater controller 15. The feedwater controller 15 basically outputs a signal that has been controlled and operated so as to make the water level in the condenser 3 of the first turbine plant constant into the feedwater control valve 16 to control the feedwater flow rate from the second turbine plant to the steam generator 1. Further, an output signal from the feedwater controller 15 is corrected by detection signals from the condenser level detecting unit 20, the main steam flow detecting unit 18 and the feedwater flow detecting unit 19. The water level signal from the steam generator 1 has been used as a signal for correcting the output signal from the feedwater controller 15 so as to make the water level in the steam generator 1 constant, as in the case of the fifth embodiment, when the first turbine plant 100 stops and only the second turbine plant side operates.

Figure 7:
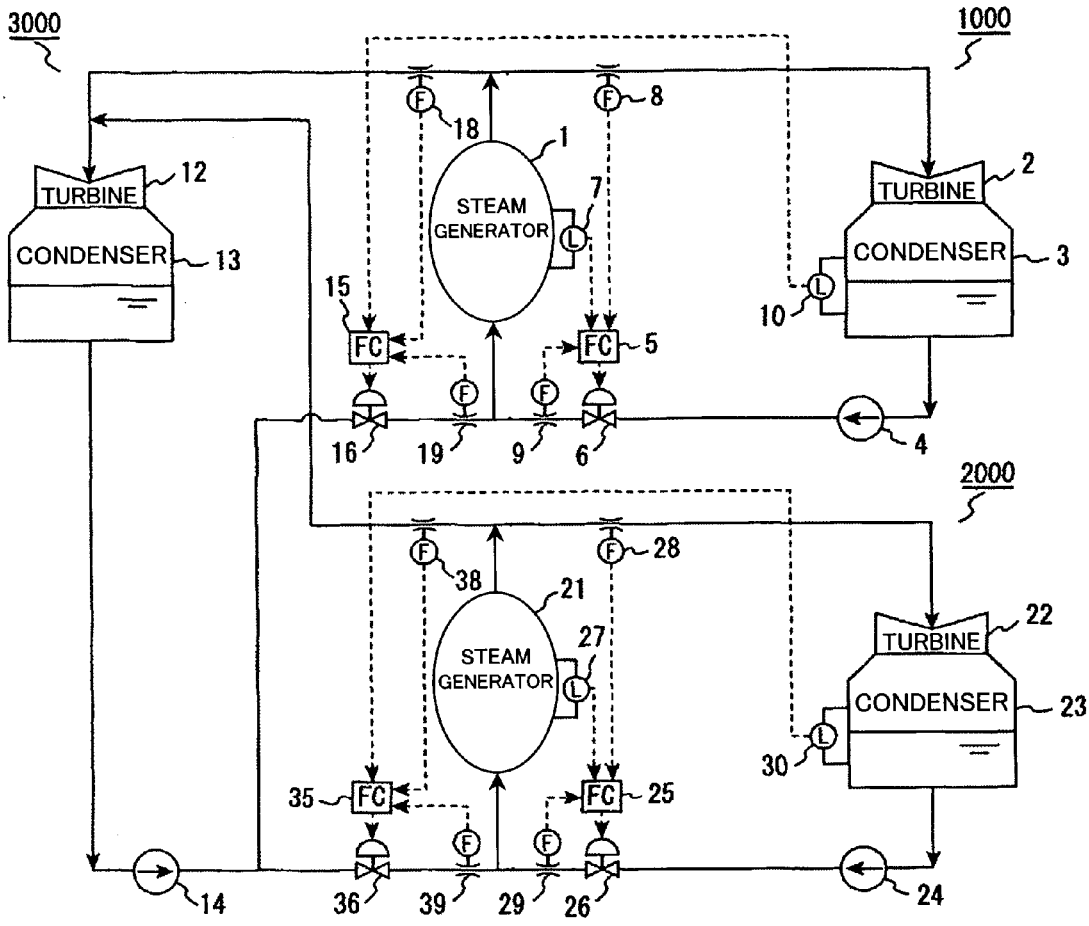
FIG. 7 is an explanatory view when the present invention has been applied to a feedwater control system for a power plant comprising two steam generators and three turbine plants combined (seventh embodiment)

With reference to FIG. 7, the description will be made of a seventh embodiment. In the present embodiment, the present invention has been applied to a feedwater control system for a power plant comprising two steam generators and three turbine plants combined.

The present embodiment is comprised of two systems. One system is constructed such that steam generated in the steam generator 1 is diverted and supplied as turbine driving steam for the first turbine plant (main turbine plant) 1000 and a third turbine plant (duplicate turbine plant) 3000; steam that flows into each turbine 2, 12 flows into the condenser 3, 13 after driving the turbine 2, 12; water condensed by the condenser 3, 13 merges via the pump 4, 14 and the feedwater control valve 6, 16 to feedwater into the steam generator 1. The other system is constructed such that steam generated in a steam generator 21 is diverted and supplied as turbine driving steam for the second turbine plant (main turbine plant) 2000 and a third turbine plant (duplicate turbine plant) 3000; steam that flows into each turbine 22, 12 flows into the condenser 23, 13 after driving the turbine 22, 12; water condensed by the condenser 23, 13 merges via the pump 24, 14 and a feedwater control valve 26, 36 to feedwater into a steam generator 21.

The feedwater control system (hereinafter, referred to as first feedwater control system in the present embodiment and the eighth embodiment) of the first turbine plant is, as in the case of the first embodiment, comprised of a steam generator level detecting unit 7, a main steam flow detecting unit 8, a feedwater flow detecting unit 9 and a feedwater controller 5. A detection signal from each detecting unit is inputted into the feedwater controller 5, and the feedwater controller 5 outputs a signal that has been controlled and operated so as to make the water level in the steam generator 1 constant into the feedwater control valve 6. The feedwater control valve 6 is open-close adjusted, whereby a feedwater flow rate from the first turbine plant to the steam generator 1 is controlled.

The feedwater control system (hereinafter, referred to as second feedwater control system in the present embodiment and the eighth embodiment) of the second turbine plant is comprised of a steam generator level detecting unit 27, a main steam flow detecting unit 28, a feedwater flow detecting unit 29 and a feedwater controller 25. A detection signal from each detecting unit is inputted into a second feedwater controller 25, and the feedwater controller 25 outputs a signal that has been controlled and operated so as to make the water level in a steam generator 21 constant into a feedwater control valve 26. The feedwater control valve 26 is open-close adjusted, whereby a feedwater flow rate from the second turbine plant to the steam generator 21 is controlled.

A third turbine plant has two feedwater control systems (hereinafter, referred to as third A feedwater control system and third B feedwater control system), and these third A feedwater control system and third B feedwater control system have functions similar to the third embodiment shown in FIG. 3.

The third A feedwater control system is constructed such that signals from the condenser water level detecting unit 10 of the first turbine plant, and the main steam flow detecting unit 18 and the feedwater flow detecting unit 19 on the third turbine plant side are inputted into the feedwater controller 15 and a signal that has been controlled and operated so as to make the water level in the condenser 3 of the first turbine plant constant is outputted from the feedwater controller 15 into the feedwater control valve 16 to control the feedwater flow rate from the third turbine plant to the steam generator 1.

The third B feedwater control system is constructed such that signals from the condenser water level detecting unit 10 of the second turbine plant, and the main steam flow detecting unit 38 and the feedwater flow detecting unit 39 on the third turbine plant side are inputted into the feedwater controller 35 and a signal that has been controlled and operated so as to make the water level in the condenser 23 of the second turbine plant constant is outputted from the feedwater controller 35 into the feedwater control valve 36 to control the feedwater flow rate from the third turbine plant to the steam generator 21.

In the case of the present seventh embodiment, as in the case of the above-described embodiments, the water level in each steam generator of the first turbine plant and the second turbine plant which are the main turbine plants is controlled so as to become constant only by the feedwater control system on the first turbine plant side or the second turbine plant side, whereby the water level in the steam generator of the first turbine plant and the second turbine plant is stabilized. Also, since to the third A feedwater control system on the third turbine plant side, a condenser level signal on the first turbine plant side, and a main steam flow signal and a feedwater flow signal on the third turbine plant side are inputted, and the feedwater control valve 16 is controlled such that the water level in the condenser of the first turbine plant becomes constant, the flow rate balance between the main steam flow rate and the feedwater flow rate of the first turbine plant and the third turbine plant can be thereby stabilized. Also, since to the third B feedwater control system on the third turbine plant side, a condenser level signal on the second turbine plant side, and a main steam flow signal and a feedwater flow signal on the third turbine plant side are inputted, and a feedwater control valve 36 is controlled such that the water level in the condenser of the second turbine plant becomes constant, the flow rate balance between the main steam flow rate and the feedwater flow rate of the second turbine plant and the third turbine plant can be thereby stabilized.

Figure 8:
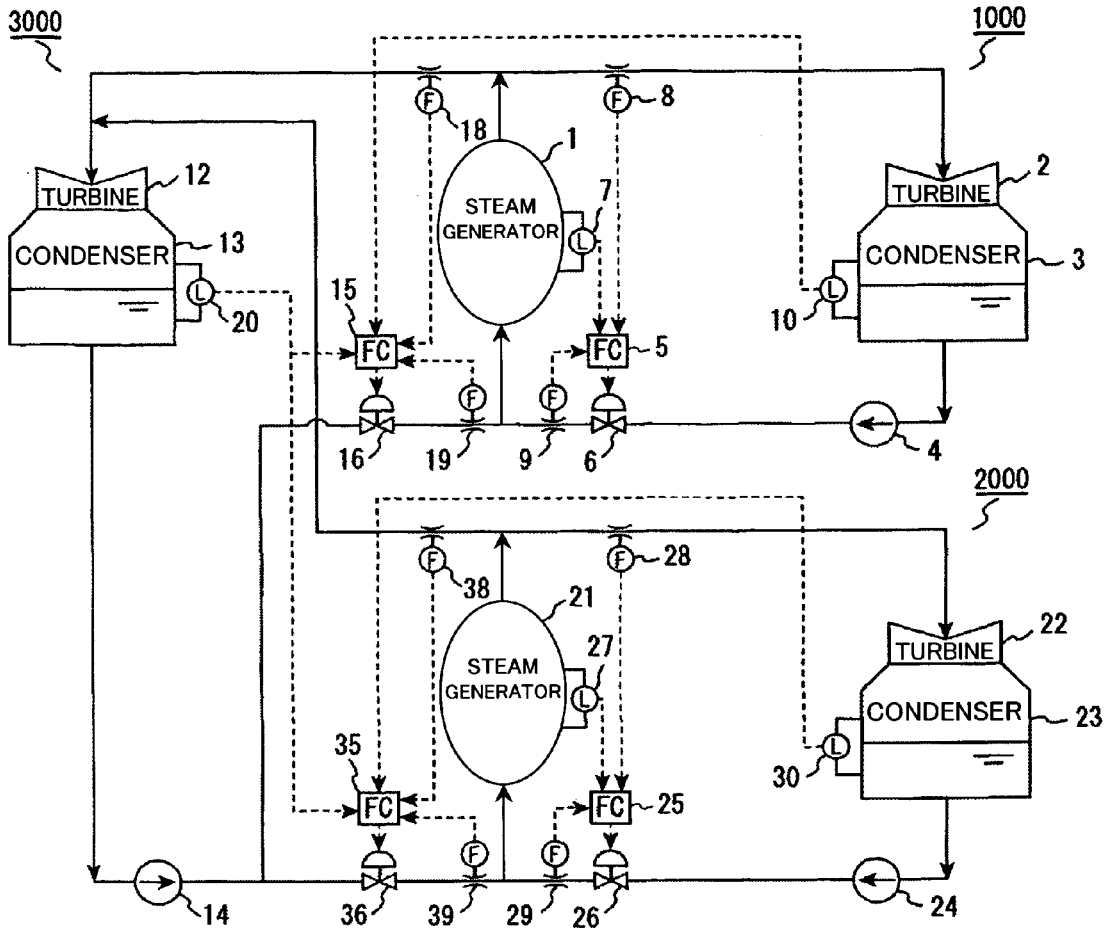
FIG. 8 is an explanatory view when the present invention has been applied to a feedwater control system for a power plant comprising two steam generators and three turbine plants combined (eighth embodiment)

With reference to FIG. 8, the description will be made of an eighth embodiment. In the present embodiment, as in the case of the seventh embodiment, the present invention has been applied to a feedwater control system of a power plant comprising two steam generators and three turbine plants combined. Although similar to FIG. 7 in system structure, the feedwater control system of the third turbine plant has been caused to have functions similar to the feedwater control system of the fourth embodiment shown in FIG. 4.

The first feedwater control system of the first turbine plant and the second feedwater control system of the second turbine plant are similar to the seventh embodiment respectively, and the detailed description will be omitted.

The third A feedwater control system and the third B feedwater control system of the third turbine plant have also structure/function substantially similar to the embodiment of FIG. 7, and further the structure is arranged such that a detection signal from the condenser level detecting unit 20 of the third turbine plant is inputted into the feedwater controller 15 of the third A feedwater control system and the feedwater controller 35 of the third B feedwater control system respectively. Because of this structure, the flow rate balance between the main steam flow rate and the feedwater flow rate of the first turbine plant and the third turbine plant can be stabilized, and the flow rate balance between the main steam flow rate and the feedwater flow rate of the second turbine plant and the third turbine plant can be stabilized.

In the seventh embodiment and the eighth embodiment, the structure is arranged such that two steam generators and three turbine plants are combined, and even when the respective numbers of the steam generators and the turbine plants are increased to exceed the above-described numbers, by the application of the present invention, the water level in each steam generator and the flow rate balance between the main steam flow rate and the feedwater flow rate of each plant can be stabilized.

Figure 9:
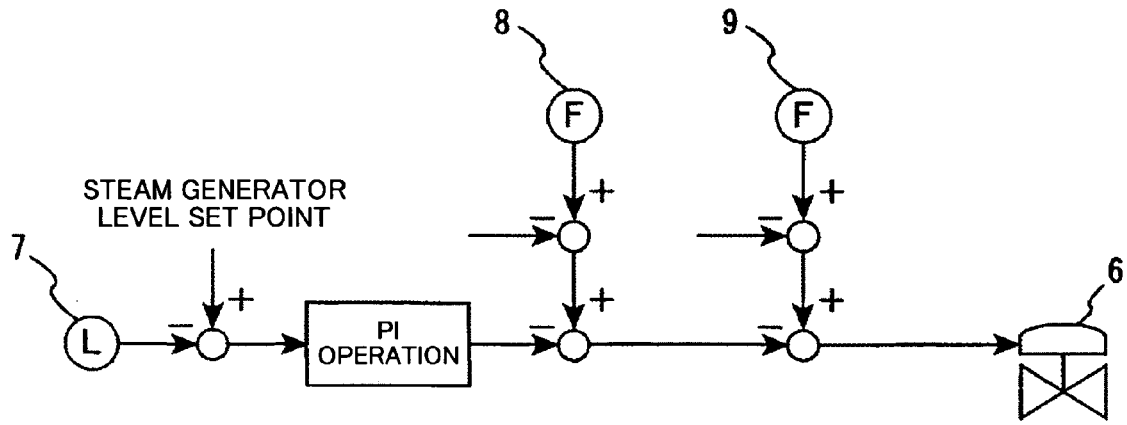
FIG. 9 is a view showing an embodiment of a control block of a feedwater controller for a main turbine plant.
Figure 10:
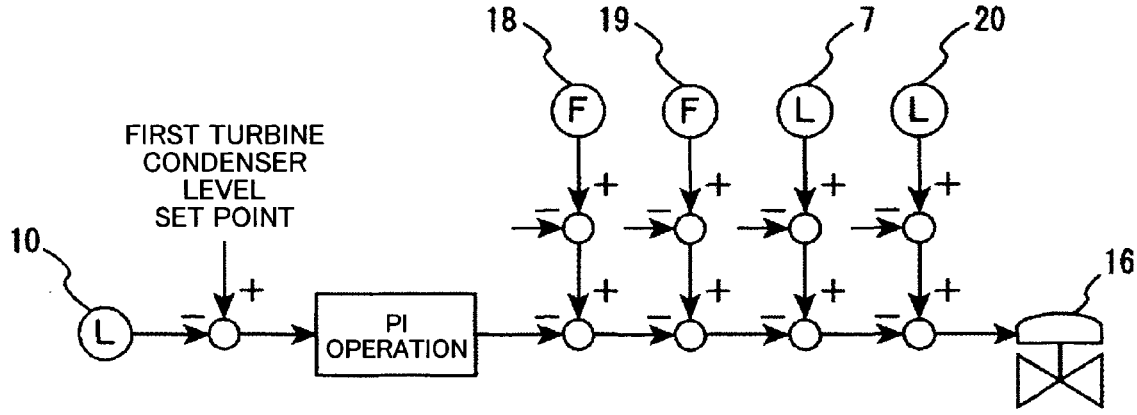
FIG. 10 is a view showing an embodiment of a control block of a feedwater controller for a duplicate turbine plant.

FIGS. 9 and 10 show an embodiment of a control block of the above-described feedwater controller.

FIG. 9 shows a control block in the feedwater controller 5 of the first turbine plant, and control similar to the conventional PI control has been used. A detection signal from the steam generator level detecting unit 7 is inputted into the feedwater controller, and deviation between this detection signal and a steam generator level set point is given to a PI operator in the feedwater controller. Thus, on the basis of a difference between a detection signal from the main steam flow detecting unit 8 and a set point of the main steam flow rate, the output signal from the PI operator is corrected (addition and subtraction operation). Similarly, on the basis of a difference between a detection signal from the feedwater flow detecting unit 9 and a set point of the feedwater flow rate, an output signal from the PI operator is corrected (addition and subtraction operation), and is adapted to be outputted to the feedwater control valve 6 as a control signal. A feedwater controller 25 in the eighth embodiment shown in FIG. 8 is also constructed by a similar control block.

FIG. 10 illustrates a control block of the feedwater controller of the second turbine plant (first to sixth embodiments) with the feedwater controller 15 of the sixth embodiment as one embodiment. To the feedwater controller 15 of the second turbine plant, a detection signal from the condenser level detecting unit 10 of the first turbine plant is inputted. The feedwater controller 15 performs the PI operation of the deviation from the set point of the water level in the first turbine condenser. The output signal of this PI operation is corrected (addition and subtraction operation) on the basis of differences between detection signals from the steam generator level detecting unit 7, the main steam flow detecting unit 18, the feedwater flow detecting unit 19, and the condenser level detecting unit 20 of the second turbine plant, and each set point. The output signals corrected by detection signals from each detecting unit are adapted to be outputted to the feedwater control valve 16 as control signals. As regards other embodiments including FIG. 1 and the like, since only different in correction signal and similar in basic structure/function, the description will be omitted.

Figure 11:
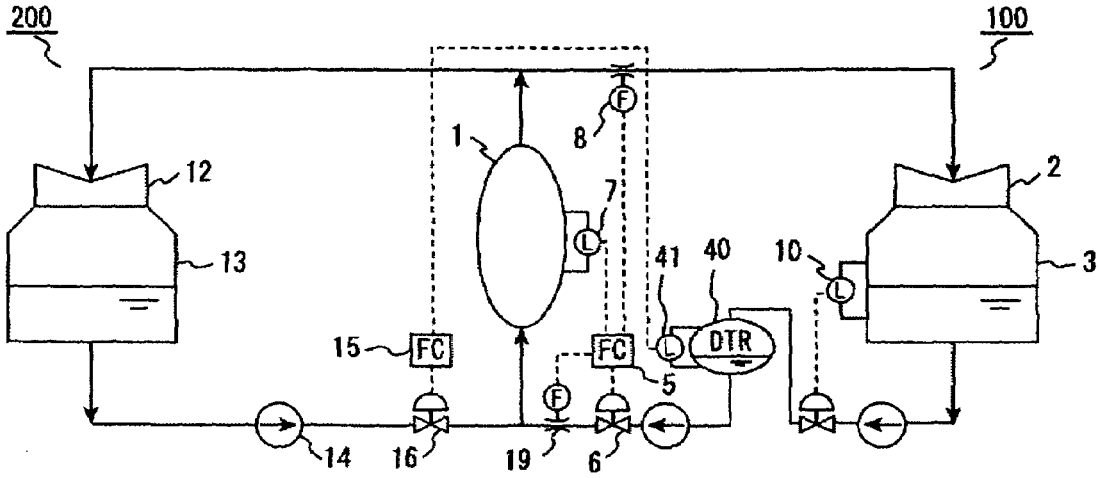
FIG. 11 is an explanatory view when the present invention has been applied to a feedwater control system for a power plant comprising one steam generator and two turbine plants combined (ninth embodiment).

Next, with reference to FIG. 11, the description will be made of a ninth embodiment. In the embodiment of FIG. 1, in the control of the second feedwater control system of the second turbine plant, the water level signal from the condenser 3 of the first turbine plant has been used. In the present embodiment, however, a detection signal from a deaerator level detecting unit 41 for detecting a water level in the deaerator 40, that is quantity of state of a feedwater system that stands in correlation with the water level in the condenser 3 is inputted into the feedwater controller 15 of the second turbine plant to control the feedwater control valve 16. This is similar to the embodiment of FIG. 1 in other structure/function. Even the present embodiment has the similar effect to the first embodiment. Also, a system in which the water level signal from the deaerator of the first turbine plant is used as input to the feedwater controller 15 is also similarly applicable to a system in which the water level signal in the condenser 3 of the first turbine plant in other embodiments such as FIG. 2 is used in addition to the first embodiment of FIG. 1.

What is claimed is:

1. In a power plant comprising a steam generator; a first turbine plant having a steam turbine to be driven by steam from said steam generator, a condenser for condensing steam from said steam turbine, a feedwater system for feeding water from said condenser to said steam generator, and a feedwater amount adjusting mechanism for adjusting an amount of feedwater to said steam generator in said feedwater system; a second turbine plant, which is a different turbine plant from said first turbine plant, having another steam turbine to be driven by steam from said steam generator, another condenser for condensing steam from said another steam turbine, another feedwater system for feeding water from said another condenser to said steam generator, and another feedwater amount adjusting mechanism for adjusting an amount of feedwater to said steam generator in said another feedwater system; and a feedwater control system for controlling said feedwater amount adjusting mechanism of said first turbine plant and said another feedwater amount adjusting mechanism of said second turbine plant; said feedwater control system comprising:

a first feedwater controller for controlling said feedwater amount adjusting mechanism of said first turbine plant on the basis of a water level in said steam generator;

and a second feedwater controller for controlling said another feedwater amount adjusting mechanism of said second turbine plant on the basis of quantity of state of said condenser or said feedwater system of said first turbine plant.

2. The feedwater control system according to claim 1, wherein said first turbine plant is a main turbine plant which uses steam from said steam generator, and said second turbine plant is a duplicate turbine plant which uses surplus steam generated in said steam generator.

3. The feedwater control system according to claim 1, wherein quantity of state of said condenser or said feedwater system of said first turbine plant is a water level in said condenser or a deaerator of said first turbine plant.

4. The feedwater control system according to claim 3, wherein said second feedwater controller uses a water level detection signal from said another condenser or another deaerator of said second turbine plant as a correction signal.

5. The feedwater control system according to claim 3, wherein said second feedwater controller uses a detection signal for a main steam flow rate to said another steam turbine of said second turbine plant, and a detection signal for a feedwater flow rate to said steam generator from said another feedwater system of said second turbine plant as a correction signal.

6. The feedwater control system according to claim 4, wherein said second feedwater controller uses a detection signal for a main steam flow rate to said another steam turbine of said second turbine plant, and a detection signal for a feedwater flow rate to said steam generator from said another feedwater system of said second turbine plant as a correction signal.

7. The feedwater control system according to claim 3, wherein said second feedwater controller uses a water level detection signal of said steam generator, a detection signal for a main steam flow rate to said another steam turbine of said second turbine plant, and a detection signal for a feedwater flow rate to said steam generator from said another feedwater system of said second turbine plant as a correction signal.

8. The feedwater control system according to claim 4, wherein said second feedwater controller uses a water level detection signal from said steam generator, a detection signal for a main steam flow rate to said another steam turbine of said second turbine plant, and a detection signal for a feedwater flow rate to said steam generator from said another feedwater system of said second turbine plant as a correction signal.

9. In a power plant comprising a steam generator; a main turbine plant having a steam turbine to be driven by steam from said steam generator, a condenser for condensing steam from said steam turbine, a feedwater system for feeding water from said condenser to said steam generator, and a feedwater amount adjusting mechanism for adjusting an amount of feedwater to said steam generator in said feedwater system; a duplicate turbine plant having another steam turbine to be driven by surplus steam generated by said steam generator, another condenser for condensing steam from said another steam turbine, another feedwater system for feeding water from said another condenser to said steam generator, and another feedwater amount adjusting mechanism for adjusting an amount of feedwater to said steam generator in said another feedwater system; and a feedwater control system for controlling said feedwater amount adjusting mechanism of said main turbine plant and said another feedwater amount adjusting mechanism of said duplicate turbine plant; said feedwater control system comprising:

a feedwater controller for outputting a control signal to said another feedwater amount adjusting mechanism of said duplicate turbine plant on the basis of a water level signal from said condenser or a deaerator of said main turbine plant.

10. A power plant comprising:

a steam generator; and a turbine plant having a steam turbine, a condenser, a feedwater system between said condenser and said steam generator, an amount of feedwater adjusting mechanism for adjusting an amount of feedwater to said steam generator in said feedwater system, and a feedwater controller for outputting a control signal to said amount of feedwater adjusting mechanism, wherein said turbine plant is comprised of an existing main turbine plant and a newly-established duplicate turbine plant which uses surplus steam generated by said steam generator, and wherein said feedwater controller controls said amount of feedwater adjusting mechanism of said duplicate turbine plant on the basis of a water level signal from said condenser or a deaerator of said main turbine plant.

11. A method of controlling an amount of feedwater to a steam generator in a power plant comprising one steam generator and a plurality of turbine plants comprising a first and second turbine plants, comprising the steps of:

controlling a feedwater control valve of the first turbine plant on the basis of detection signals from a steam generator level detecting unit, a main steam flow detecting unit and a feedwater flow detecting unit of the first turbine plant, and controlling a feedwater control valve of the second turbine plant on the basis of a detection signal from a condenser level detecting unit of the first turbine plant.

* * * * *